US005320693A

United States Patent [19]

Helf

[11] Patent Number: 5,320,693

[45] Date of Patent: Jun. 14, 1994

[54] SELECTABLY-REMOVABLE INDICIA-CONTAINING SURFACE-COATING COMPOSITE AND METHOD

[75] Inventor: Thomas A. Helf, New Berlin, Wis.

[73] Assignee: S. C. Johnson & Son, Inc., Racine, Wis.

[21] Appl. No.: 887,613

[22] Filed: May 22, 1992

[51] Int. Cl.[5] ..... B05D 5/00; E04F 15/00

[52] U.S. Cl. ..... 156/71; 156/234; 156/344; 156/240; 427/154

[58] Field of Search ..... 156/234, 235, 71, 63, 156/344, 248, 240; 427/140, 154

[56] References Cited

U.S. PATENT DOCUMENTS

| | | | |
|---|---|---|---|
| 2,125,865 | 8/1938 | Bartelstone | 156/248 |
| 2,351,933 | 6/1944 | Decker | 156/240 |
| 3,499,781 | 3/1970 | Krueckel | 430/295 |
| 3,707,792 | 1/1973 | Mabrey et al. | 40/219 |
| 3,836,420 | 9/1974 | Freese | 428/134 |
| 3,855,170 | 12/1974 | Junkin et al. | 525/221 |
| 4,391,858 | 7/1983 | Batzill | 427/407.1 |
| 4,529,632 | 7/1985 | Fujii et al. | 427/407.1 |
| 4,680,237 | 7/1987 | Kenney | 428/520 |
| 4,845,149 | 7/1989 | Frazee | 524/460 |
| 4,879,333 | 11/1989 | Frazee | 524/460 |
| 4,923,919 | 5/1990 | Frazee | 524/460 |
| 5,093,396 | 3/1992 | Calhoun et al. | 524/204 |
| 5,167,087 | 12/1992 | Plumly | 40/600 X |

OTHER PUBLICATIONS

Test Methods for Pressure Sensitive Tapes, published in 1985 by the Pressure Sensitive Tape Council of Glenview, IL.

*Primary Examiner*—David A. Simmons
*Assistant Examiner*—Charles Rainwater
*Attorney, Agent, or Firm*—R. E. Rakoczy; J. W. Frank

[57] ABSTRACT

A novel, layered, indicia-containing, surface-coating composite for application to a substrate such as a floor is disclosed. The novel composite comprises a layer of pressure-sensitive adhesive and a layer of indicia having the layer of pressure-sensitive adhesive on one side thereof. The pressure-sensitive adhesive layer secures the indicia layer to the floor. "Tack" properties of the pressure-sensitive adhesive may range from 50 to 2000 grams per square centimeter. The novel composite further includes an alkali-soluble transparent polymeric layer on the opposite side of the indicia layer. Also disclosed is a method of applying, and then selectably removing, such an indicia-containing surface-coating composite from the floor.

3 Claims, 1 Drawing Sheet

SELECTABLY-REMOVABLE INDICIA-CONTAINING SURFACE-COATING COMPOSITE AND METHOD

TECHNICAL FIELD

One aspect of my present invention is directed to an indicia-containing surface-coating composite that is selectably removable from a substrate such as a floor. Another aspect of my present invention is directed to a method of applying, and then selectably removing, such an indicia-containing surface-coating composite from the floor.

BACKGROUND ART

When shopping for desired merchandise, certain shoppers wish to be abe to quickly locate desired products. However, because many of the so-called "high-volume" shopping centers of today resemble warehouses, the sheer size of such shopping centers would seem to pose an obvious impediment to quickly locating such desired products.

Therefore, to enable shoppers to quickly locate desired products, certain merchandisers make use of floor indicia.

Floor indicia, stated simply, is certain information that is applied to a floor. Such information may take the form of written instructions, often tersely worded, which may further be coupled with generally-recognized corporate logo or other well-known corporate symbols, trademarks, and so forth, to thereby enable shoppers to quickly ascertain the location of various desired products.

Such indicia may typically be applied to a floor surface that is generally smooth. Illustrative generally smooth floor surfaces include wood, various metallic surfaces, linoleum, various polymeric floor surfaces including vinylic flooring materials and, in certain shopping malls, marble, polished granite, terrazzo, various tile materials including quarry tile, and so forth.

In general, the application of indicia to a surface for a variety of purposes is well-known to those skilled in this particular area of technology. See, for example, U.S. Pat. No. 3,499,781 to Krueckel; U.S. Pat. No. 3,707,792 to Mabrey et al ; U.S. Pat. No. 3,836,420 to Freese; and U.S. Pat. No. 4,680,237 to Kenney et al.

The current state-of-the-art, however, has room for improvement. In particular, in the last, above-noted U.S. Pat. No. 4,680,237 there is disclosed a two-step method or procedure for applying certain colored indicia to a floor.

A first step of the '237 patent, for example, discloses forming a base layer on the floor by applying a liquid layer of an unpigmented, so-called "metal interlock" acrylic finish to the floor and, thereafter, allowing the metal interlock acrylic finish to air dry. A second step as disclosed in the '237 patent includes forming a pigmented layer over the base layer by next applying a liquid layer of a pigmented, metal interlock acrylic finish over the base layer and, thereafter, allowing the pigmented layer to dry.

Thus, when utilizing the two-step procedure disclosed in U.S. Pat. No. 4,680,237 (to Kenney et al.), the first liquid layer must be allowed to dry before the second liquid layer is applied to the first layer. In other words, the two-step procedure disclosed in U.S. Pat. No. 4,680,237 requires two separate drying steps. The requirement of two, separate drying steps, however, might be viewed by some merchandisers as a "problem". For example, in certain situations it might be very undesirable to be required to spend time waiting for two, separate liquid layers to dry.

Advantageously, and in connection with the method aspect of my present invention, there is only one such drying step.

Additional problems are typically experienced when such indicia—applied to a floor—is subjected to normal wear or traffic patterns. For instance, shopping cart tire marks, heel scuffs, and various standard floor-maintenance practices will ultimately cause certain floor-applied indicia to become illegible or otherwise damaged.

It would therefore be desirable to apply a protective coating over such indicia, for purposes of protecting such damage from occurring.

Yet, many merchandisers may desire to be able to quickly remove such floor indicia, whenever desired. In this regard, present removal practices often include mechanically removing—such as by scraping and/or sanding—the indicia from the floor, such methods occasionally requiring the use of special tools. There thus may be certain unbudgeted manpower costs as well as certain unbudgeted equipment costs associated with the practice of such conventional indicia-removal methods. It is, of course, desirable for the merchandiser that any such unbudgeted costs be reduced to a minimum. It can further be appreciated that occasionally, certain conventional indicia-removal methods will cause damage—to some degree—to the underlying substrate surface, which is of course also undesirable.

SUMMARY DISCLOSURE OF THE INVENTION

Accordingly, and as was mentioned above, one aspect of my present invention is directed to a novel, layered indicia-containing surface-coating composite for application to a substrate such as a floor. My novel layered surface-coating composite includes a relatively-thin layer of indicia having a layer of pressure-sensitive adhesive on one side thereof (i.e., the underside), which adhesive is used to secure the indicia layer to the floor.

Physical properties of a particular pressure-sensitive adhesive are specifically so selected such that the adhesive layer bonds preferentially to the indicia layer rather than to the floor and, further, such that the indicia is readily removably from the floor.

The surface-coating composite of my present invention further includes an alkali-soluble, transparent polymeric layer, on the opposite side (i.e., the exposed, upper surface) of the indicia layer, which polymeric layer functions as a protective coating over the indicia layer.

My method of applying the layered indicia-containing surface-coating composite to a substrate such as a floor includes a series of steps. However, and as was mentioned above, there is only one "drying" step.

For example, a first step of my method is to affix to the floor a relatively-thin layer of indicia having a relatively thin layer or film—preferably an extremely-thin layer or film—of pressure-sensitive adhesive on one side thereof, the pressure-sensitive adhesive layer thus securing the indicia layer to the floor.

Another step is subsequently to apply onto the layer of indicia a liquid, alkali-soluble, polymeric material. The liquid alkali-soluble polymeric material that is so chosen is able to dry, to become the alkali-soluble, transparent polymeric layer mentioned above. A subsequent step is then to dry the liquid alkali-soluble polymeric material (the "drying" step), thereby forming the above-mentioned alkali-soluble, transparent polymeric layer on the layer of indicia.

Thereafter, to remove from the floor the thus-applied, layered indicia-containing surface-coating composite, one simply applies alkali to the upper surface of the transparent polymeric layer, in an amount that is effective for causing the transparent polymeric layer to dissolve, thereafter removing the now-dissolved polymeric layer from the layer of indicia. The layer of indicia, depending upon the physical properties of the particular pressure-sensitive adhesive selected beforehand, can then readily be simply removed from the floor, as desired.

Briefly summarizing, the composite of my invention will thus provide for prolonged indicia legibility, principally because of the above-mentioned solid nature and adhesive qualities of my composite.

These and other aspects and/or features of my present invention will be described in detail below.

INDUSTRIAL APPLICABILITY

In certain commercial settings—such as loading docks, large-scale warehouses, and so forth—it may be desirable to display directional aids in the form of arrows or color-coded markings, to thereby provide directional assistance to certain material handlers such as forklift operators. Such directional aids as well as other informative messages are often displayed on signs attached to ceilings, walls, pillars or other building structural elements.

However, through carelessness—e.g., of the forklift operator driving too fast, perhaps, within a warehouse—such signs may become so damaged as to be rendered illegible, or such signs may cause an injury, if hung too low, or if extending too greatly from a wall or pillar.

Use of the present invention as an advertising aid, another useful feature or aspect of the present invention, will moreover become readily apparent to those skilled in the art of sales.

Therefore, in various commercial settings it might be very desirable to be able to use any and all available floor space, for purposes of displaying such directional and/or advertising aids, as are briefly discussed above.

In this regard, and as was mentioned above, illustrative generally smooth floor surfaces, particularly suitable for use in connection with my invention would include wood, various metallic surfaces, linoleum, various polymeric floor surfaces including vinylic flooring materials and, in certain shopping malls, marble, polished granite, terrazzo, various tile materials including quarry tile, and so forth.

In addition, certain "rougher" surfaces such as loading areas and platforms as well as stairs and landings would be suitable for use in connection with my invention.

Moreover, the present invention can be employed to apply an indicia-containing composite of the sort disclosed herein to even rougher surfaces such as various road and/or highway surfaces, such as are made of concrete, asphalt, and so forth.

Such indicia-containing composites, in accordance with certain principles of my present invention, would thus be selectably-removable from such various surfaces, which is of course a desirable result.

This patent specification accordingly discloses not only my novel layered indicia-containing surface-coating composite but also a method of applying such a layered indicia-containing composite to various substrate surfaces, e.g. of the various sorts mentioned above, for purposes of providing such surfaces with selectably-removable indicia.

BRIEF DESCRIPTION OF THE DRAWINGS

The accompanying drawing figures will now briefly be summarized.

Throughout the drawing figures, like reference numerals refer to like elements and/or components.

BEST MODE FOR CARRYING OUT THE INVENTION

Figure 1:
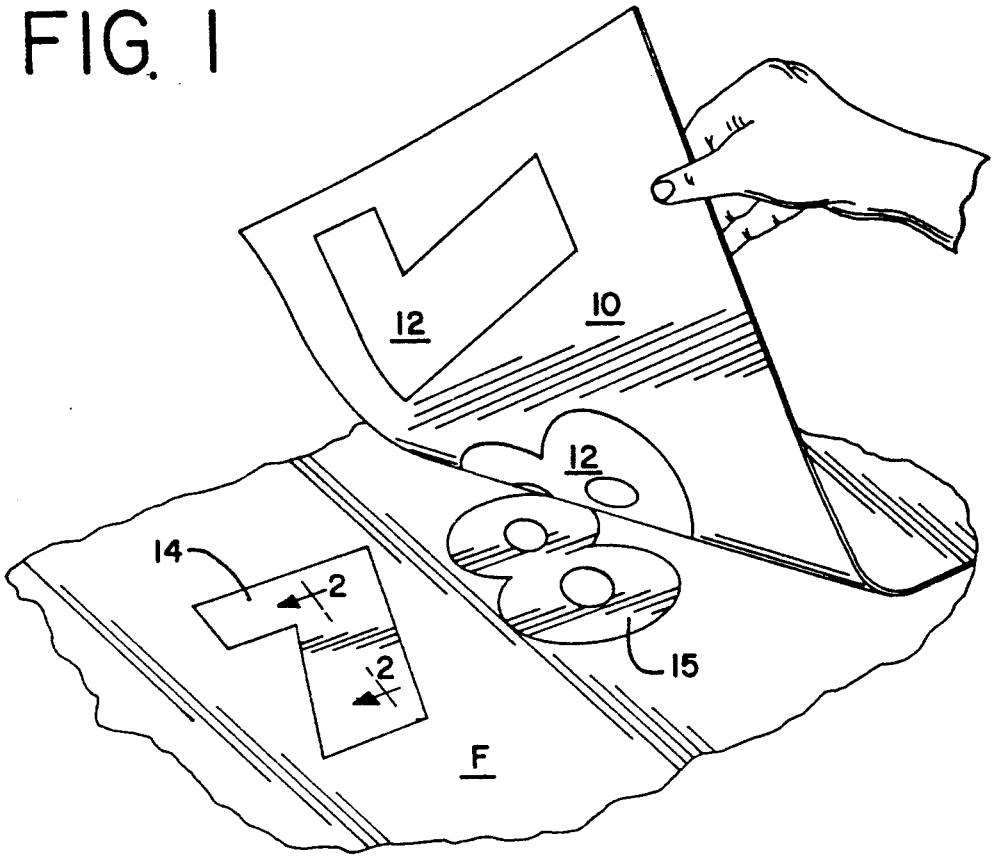
FIG. 1 is a perspective view, illustrating one method of applying certain indicia directly onto a floor, in accordance with certain principles of my present invention.

In FIG. 1, there are shown the numerals "7" and "8", each such numeral representing certain indicia that is to be affixed to a particular substrate such as a floor ("F").

At this point in this specification, it is important to bear in mind, in accordance with certain aspects and/or features of my present invention, that the indicia is not only able to take a variety of shapes and forms but also that the indicia is able to be made of various substances. In this regard, the choice of a suitable material for the indicia layer will often be dictated by the desired end-use of the layered indicia-containing surface-coating composite.

Accordingly, a suitable material or substance for the indicia layer might be a fabric; a foil or another metallic sheeting material; paper or other cellulosic sheeting material; various polymeric sheeting materials such as polyacetal film, polyamide film, polyanhydride film, polyester film, polyolefin film, polystyrene film, polyvinyl chloride ("PVC") film, polyvinylidene chloride film, polyurethane film, polyurea film, and so forth.

Also, the relative "thickness" or "thinness" of the indicia layer may vary (as needed) to meet a particular purpose or end-use. For example, it might be necessary that the indicia be thick enough not to tear when removal of the indicia from the floor is desired, or it may be desirable that the indicia layer be so thin as to seem to "blend in with" the surrounding floor surface.

In any event, I accordingly prefer to use, as my indicia layer, commercially-available polyvinyl chloride ("PVC") sheeting material having a film thickness which ranges from about 1 mil to about 3 mils, and which is preferably about 2 mils. (A "mil" is defined as being one one-thousandth of an inch; and an inch is defined as being 2.54 centimeters.)

Suitable polyvinyl chloride ("PVC") sheeting material may presently be purchased from the 3M Company of St. Paul, Minnesota. Such PVC sheeting material can (please refer to FIG. 1) itself be a composite, comprising a PVC film layer 10 affixed by a pressure-sensitive adhesive (not shown) to a backing sheet or web 12.

As is suggested by FIG. 1, certain portions of the PVC film layer 10 can be pre-cut to provide certain indicia, such as the numbers "7" and "8", respectively identified with the reference numerals 14 and 15, for application; to the floor.

In such an embodiment, it is preferable that the above-mentioned pressure-sensitive adhesive (not shown), which is utilized to affix the PVC film layer 10 to the backing sheet or web 12, remain on the backing sheet 12 when the illustrated indicia 14 and 15 becomes separated from the PVC film layer. In such an embodiment, it is further preferable that only the indicia (e.g., the numbers "7" and "8", respectively identified with the reference numerals 14 and 15) have a layer of pressure-sensitive adhesive 16 on the opposite side thereof, to thereby enable such indicia 14 to readily be applied to various substrates such s the floor ("F"), as is shown in FIGS. 1 and 2.

Figure 2:
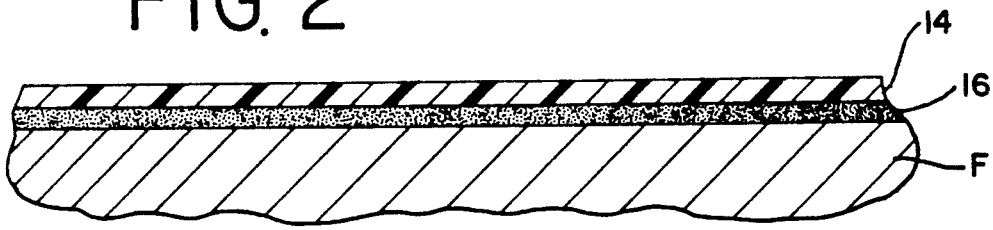
FIG. 2 is a sectional view, taken from the plane 2—2 in FIG. 1 and presenting the indicia layer on an enlarged scale relative to FIG. 1.
Figure 3:
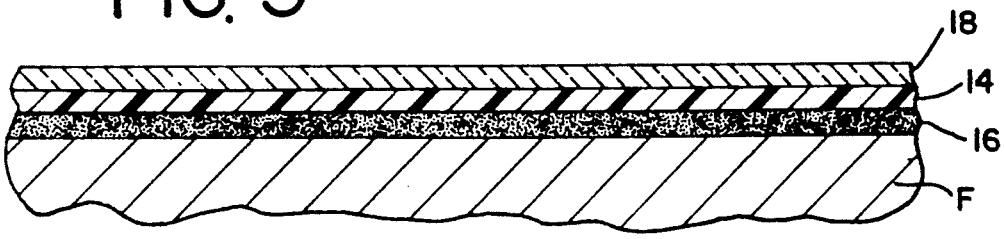
FIG. 3 is a sectional view similar to FIG. 2 but further presenting an alkali-soluble transparent polymeric layer on the indicia layer.

The thickness of the illustrated layer of pressure-sensitive adhesive 16 of FIGS. 2 and 3 has been depicted exaggerated, relative to the thickness of the indicia layer 14, for purposes of clarity. As was mentioned above, the preferred thickness of the illustrated indicia layers 14 and 15 is preferably about 2 mils.

In accordance with certain principles of my present invention the thickness of the adhesive layer 16 may vary from about 0.1 mil to 3 mil. Preferably, however, the pressure-sensitive adhesive layer 16 is an extremely-fine film and thus has a thickness of much less than 2 mils.

At this point, I should now like to briefly discuss the "tack" qualities of the pressure-sensitive adhesive layer 16.

Briefly, the term "tack" relates to the rate at which an adhesive bond forms between two surfaces, such as floor ("F") and indicia 14, as illustrated in FIG. 2. In this regard, the "tack" physical properties of a particular pressure-sensitive adhesive will need to be carefully chosen in light of various factors such as expected wear patterns caused by overpassing traffic, the amount of time that the indicia is to remain affixed to the floor, and so forth.

As those skilled in the art of pressure-sensitive adhesives well-know, such "tack" physical properties will of course be influenced by the thinness or thickness of the adhesive layer.

Further in this regard, to determine "tack" physical properties of various pressure-sensitive adhesives, many adhesives-technology practitioners tend to use a booklet entitled Test Methods For Pressure Sensitive Tapes, eighth edition, published in 1985 by the "Pressure Sensitive Tape Council" of Glenview, Illinois.

As was briefly mentioned above, physical properties of a particular pressure-sensitive adhesive are specifically so selected such that the adhesive layer bonds preferentially to the indicia layer rather than to the floor ad, further, such that the indicia is readily removable from the floor.

In this regard, desired "tack" physical properties of the pressure-sensitive adhesive may range from 50 to 2000 grams per square centimeter; will preferably range from 100 to 1500 grams per square centimeter; and will more preferably range from 150 to 1000 grams per square centimeter. The determination of these "tack" values, as well as methods for determining "tack" values of various pressure-sensitive adhesives suitable for purposes of my present invention, are as disclosed and discussed in U.S. Pat. No. 4,879,333 to Frazee.

Accordingly, pressure-sensitive adhesives, suitable for purposes of my present invention are disclosed in U.S. Pat. Nos. 4,845,149; 4,879,333; and 4,923,919, all to Frazee.

Also mentioned above is the fact that the surface-coating composite of my present invention further includes an alkali-soluble, transparent polymeric layer 18. (Please refer to FIG. 3.) The transparent polymeric layer 18 is formed on the exposed, upper surface of the indicia layer 16 via a series of steps.

As was briefly mentioned above, a first step of my novel method is to affix to a surface such as a floor a relatively-thin layer of indicia 14 or 15 (please refer to FIG. 1), wherein the indicia layer 14 (FIG. 2) has an extremely-thin layer or film 16 of pressure-sensitive adhesive on one side thereof. (The thickness of layer 16 in FIGS. 2 and 3 relative to the thickness of layer 14 is exaggerated for purposes of clarity.) The extremely-thin pressure-sensitive adhesive layer 16 is thus used to secure the indicia layer 14 to the floor.

Another step is subsequently to apply onto the layer of indicia 14 a liquid, alkali-soluble, polymeric material. (The application of such liquid is not shown.) The liquid alkali-soluble polymeric material that is so chosen is able to dry, to thereby become the alkali-soluble transparent polymeric layer 18 mentioned above. (In FIG. 3, the thickness of layer 18 relative to the thickness of layer 14 is exaggerated for purposes of clarity.)

Accordingly, and in accordance with certain principles of my present invention, suitable liquid, alkali-soluble, polymeric material is disclosed in U.S. Pat. No. 5,093,396 to Calhoun et al. Various other liquid, alkali-soluble, polymeric materials, also suitable for purposes of my present invention, are moreover presently commercially-available.

For example, various acrylic emulsion liquid polymers, and certain styrenic liquid polymers, as well as certain dispersible polyesters and polyurethanes, all presently commercially-available, would be suitable for purposes of my present invention, provided that each such is alkali-soluble and able to dry to form a transparent polymeric layer. In this regard, certain particularly preferred specific examples—identified e.g. by the brand names "COMPLETE", "SPRINT", "VECTRA", "FUTURE", "CLEAR", "Joncryl 74", and "Joncryl 77"—would be suitable for purposes of my present invention and are all presently commercially available and manufactured by S. C. Johnson & Son, Inc. of Racine, Wisconsin.

Also briefly mentioned above is the possibility that the thus-formed polymeric layer 18 may be required to function as a "protective" coating over the indicia layer 14.

Accordingly, if protection of the indicia layer 14 is desired, certain physical properties of the thus-formed polymeric layer 18—such as resiliency, durability, resistance-to-abrasion, and so forth—may be matters worthy of consideration.

Also of possible concern may be the thickness or thinness of the overlying polymeric layer 18 relative to the thickness of the indicia layer 14. Lastly, the overall thickness of the composite, per se, may become a matter of concern, in certain cases. In this regard, the thickness of the polymeric layer 18 may typically vary from 0.1 mils to 2 mils; may preferably vary from 0.3 mils to 1 mil; and may more preferably vary from 0.4 mils to 0.6 mils.

Thus, after a suitable liquid, alkali-soluble polymeric material is selected and applied onto the indicia layer 14, the next step that occurs is that the liquid polymeric material is permitted to dry (the sole "drying" step mentioned above), to thereby become the alkali-soluble transparent polymeric layer 18, illustrated in FIG. 3.

To remove the polymeric layer 18, one then simply makes use of any one of a wide variety of commercially-available "base"-containing solutions. For example, as discussed in U.S. Pat. No. 5,093,396 (to Calhoun et al.), one might choose to apply an aqueous ammonia solution on the surface of polymeric layer 18, in an amount sufficient to dissolve the polymeric layer 18. The now-dissolved polymer could then readily be wiped from the upper surface of the indicia layer 14, thereby enabling removal of the indicia layer 14 from the floor.

Relative ease or difficulty of removal of the indicia layer 14 from the floor ("F") would of course be directly related to the "tack" qualities, selected beforehand, for the pressure-sensitive adhesive.

What has been illustrated and described herein is an indicia-containing surface-coating composite that is selectably removable from a substrate such as a floor. Also described herein is a method of applying, and then selectably removing, such an indicia-containing surface-coating composite from the floor. While the indicia-containing surface-coating composite of the present invention has been illustrated and described with reference to preferred embodiments, it is to be understood that the present invention is not to be limited to these particular embodiments. On the contrary, various modifications, as well as various structural and/or compositional alternatives, will become apparent to those skilled in the art upon reading the foregoing description. Accordingly such alternatives and modifications are to be considered as forming a part of the present invention insofar as they fall within the spirit and scope of the accompanying claims.

That which is claimed as invention is as follows:

1. A method of applying a removable layered indicia-containing surface-coating composite to a substrate, consisting essentially of the steps of:

affixing to the substrate a layer of indicia having a layer of pressure-sensitive adhesive on one side thereof, the pressure-sensitive layer securing the layer of indicia to the substrate and retaining the layer of indicia to the substrate upon exposure to alkali, and the pressure-sensitive adhesive has "tack" physical properties ranging from 50 to 2000 grams per square centimeter;

applying a liquid alkali-soluble polymeric material onto the layer of indicia, the liquid alkali-soluble polymeric material being able to dry to an alkali-soluble transparent polymeric layer; and drying the liquid alkali-soluble polymeric material, thereby forming the alkali-soluble transparent polymeric layer on the layer of indicia; and, at a later time, applying alkali to the transparent polymeric layer in an amount that is effective for causing the transparent polymeric layer to dissolve; and thereafter removing the now dissolved polymeric layer from the layer of indicia remaining on the substrate.

2. The method of claim 1 further including the step of removing the layer of indicia from the substrate.

3. The method of claim 1 wherein the indicia is an advertising aid in the form of a logo or trademark.

* * * * *